United States Patent [19]

Handschuch

[11] Patent Number: 4,718,227

[45] Date of Patent: Jan. 12, 1988

[54] OPEN-END SPINNING PROCESS AND DEVICE FOR ITS IMPLEMENTATION

[75] Inventor: Karl Handschuch, Gaimersheim, Fed. Rep. of Germany

[73] Assignee: Schubert & Salzer, Ingolstadt, Fed. Rep. of Germany

[21] Appl. No.: 878,978

[22] PCT Filed: Nov. 11, 1985

[86] PCT No.: PCT/DE85/00449

§ 371 Date: Jun. 30, 1986

§ 102(e) Date: Jun. 30, 1986

[87] PCT Pub. No.: WO86/02957

PCT Pub. Date: May 22, 1986

[30] Foreign Application Priority Data

Nov. 13, 1984 [DE] Fed. Rep. of Germany ..... 3441495

[51] Int. Cl.[4] ..... D01H 7/895; D01H 7/892

[52] U.S. Cl. ..... 57/401; 57/408; 57/413

[58] Field of Search ..... 57/400, 401, 403, 404–413, 57/415, 417, 328, 90

[56] References Cited

U.S. PATENT DOCUMENTS

| | | | |
|---|---|---|---|
| 3,885,772 | 12/1974 | Burlet | 57/408 X |
| 4,315,398 | 2/1982 | Parker et al. | 57/401 |
| 4,479,348 | 10/1984 | Yasui et al. | 57/408 X |
| 4,489,540 | 12/1984 | Faure et al. | 57/328 X |
| 4,522,023 | 6/1985 | Stahlecker et al. | 57/401 |

FOREIGN PATENT DOCUMENTS

| | | | |
|---|---|---|---|
| 928596 | 6/1973 | Canada . | |
| 1510741 | 8/1972 | Fed. Rep. of Germany . | |
| 2503919 | 5/1976 | Fed. Rep. of Germany . | |
| 1490473 | 6/1967 | France . | |
| 1231198 | 5/1971 | United Kingdom | 57/401 |

*Primary Examiner*—Donald Watkins
*Attorney, Agent, or Firm*—Julian W. Dority

[57] ABSTRACT

An open-end spinning process in which the fiber sliver is separated into single fibers and in which the separated fiber material is brought by an air stream to a collecting surface from which it is drawn off while being twisted. According to the instant invention the fiber material is deposited on a collecting surface moving in the direction of thread draw-off, is then twisted and is continuously drawn off said collecting surface in form of a thread. The single fibers are fed upon the collecting surface in the direction of said collecting surface's movement, whereby an alignment of the fibers on the collecting surface takes place. The doubling process is separated from the spinning process as the fiber material is bundled and/or doubled on the collecting surface into a fiber sliver with the fiber mass required for the desired thread. The twisting process takes place independently of the collecting surface by means of a known twisting mechanism.

25 Claims, 3 Drawing Figures

OPEN-END SPINNING PROCESS AND DEVICE FOR ITS IMPLEMENTATION

The instant invention concerns an open-end spinning process in which a mass of fibers in the form of a band is separated into separate fibers and in which the separated fiber material is fed to a collecting surface in an air stream, then to be drawn off from said collecting surface while being twisted, and further concerns a device for the implementation of said process.

Among the different open-end spinning processes the open-end rotor spinning process and the open-end friction spinning process have gained considerable importance. The latter has the special advantage over the rotor spinning process of requiring lower RPMs of the spinning elements than in the rotor spinning process, while higher production speeds are nevertheless attainable. The thinner yarns can be spun more efficiently. However, the quality of the yarns produced by the friction spinning process is unsatisfactory because the individual fibers are not fed into the spinning nip in a parallel position to the yarn axis as would be required for their orderly incorporation into the freely rotating yarn end. Measures have been proposed in the past in order to bring the fibers into a position which is nearly to the yarn axis as they are fed into the nip, for example mechanically, by means of a centrifugal disk (DE-PS No. 2,720,625) or pneumatically, by means of a cascade-like increments of the air pressure in the path of the fibers (DE-OS No. 2,732,678) or by feeding the fibers at an oblique angle in relation to the direction of thread draw-off, combined with an air stream essentially parallel to the thread axis (DE-OS No. 2,943,063). Yarn quality is not satisfactory however, in spite of these measures, especially at high spinning speeds.

It is the object of the instant invention to create an open-end spinning process making it possible to produce a yarn of good quality at high production speeds, and to create the device for the implementation of this process.

This objective is attained by the instant invention with a process where the fiber material, in the form of individual fibers, is deposited on a collecting surface moving in the thread draw-off direction and is drawn off continuously from said collecting surface in the form of a thread while being twisted. No fibers are added on to the already finished thread but are always fed to the thread end.

Oriented depositing of the fibers on the collecting surface is obtained by feeding the separate fibers in direction of the collecting surface's movement. The doubling process is separated from the spinning process by bundling and/or doubling the fiber material on the collecting surface into a fiber bundle containing the fiber mass required for the desired thread. The twisting operation is carried out suitably by a known twisting mechanism, independently from the collecting surface. Provisions can be made here for the fiber sliver being formed on the collecting surface to be deposited into the spinning nip formed by two cylinders in close proximity to each other and driven in the same direction, to be twisted into a thread and to be drawn off in continuous operation.

The device to carry out the process is characterized by a collecting surface moving in the direction of the thread draw-off and followed, in the direction of thread draw-off, by a twisting device and by a draw-off device.

In a preferred embodiment the collecting surface is placed on the periphery of a disk-like cylinder. The surface speed of the collecting surface is approximately equal to that at which the thread is drawn off, so that the full mass of fibers required to form the finished thread is collected on the collecting surface and is conveyed in form of a fiber bundle in the direction of the twisting device where it is twisted together into a thread.

Doubling does not take place in the rotating zone but in a rotation-free zone. This separation of rotation and doubling produces a yarn of good quality.

A delay and the ensuing further parallel positioning of the fibers as well as doubling of the fibers on the collecting surface, (said doubling being increased as a function of said delay), is obtained if the surface speed of the collecting surface is kept lower than the thread draw-off speed.

In order to deposit the conveyed fibers in a precisely defined width on the collecting surface, said collecting surface is made in form of a groove. The width of the groove corresponds approximately to the thickness of the arriving fiber material so that a fiber bundle is formed which closely corresponds to the yarn diameter. The preferred configuration of the cross-section of the groove is V-shaped. A rounded groove bottom favors the propagation of torsion within the fiber bundle. Secure conveying of the fibers throughout the collecting surface is ensured by holding the fibers on said collecting surface by pneumatic means.

In a preferred embodiment the collecting surface is subdivided into sectors. In this case the collecting surface has a first sector with an inwardly directed air stream extending in the sense of the collecting surface's movement from the fiber feeding point up to a second sector. Preferably the collecting surface is subjected to an outwardly flowing air stream in the area of the second sector. For this purpose the second sector is connected to the atmosphere.

In order to maintain a defined flow of air within the collecting surface area, said collecting surface is enclosed in a housing.

An opening device is provided before the collecting surface to separate and feed the fiber material onto the collecting surface. The opening device is connected to the collecting surface by a fiber channel which opens upon the collecting surface essentially at a tangent in the sense of the collecting surface's movement, said fiber channel having an outlet which is adapted to the width of the collecting surface.

Even greater precision in feeding the fibers onto the collecting surface in the direction of its movement is achieved if no fiber channel is used. This is possible if the housing of the opening device and the housing of the cylinder are immediately next to each other and connected by a connecting opening. Preferably the collecting surface is equipped with a cleaning device. A pair of friction rollers, driven in the same direction and forming a spinning nip, can serve as the twisting device whereby the axis of rotation of the collecting surface cylinder is in a plane perpendicular to the spinning nip. In another embodiment a pneumatic twisting device is installed after the collecting surface in the sense of thread draw-off.

Two examples of embodiments according to invention are shown hereinbelow through the following drawings.

Figure 2:
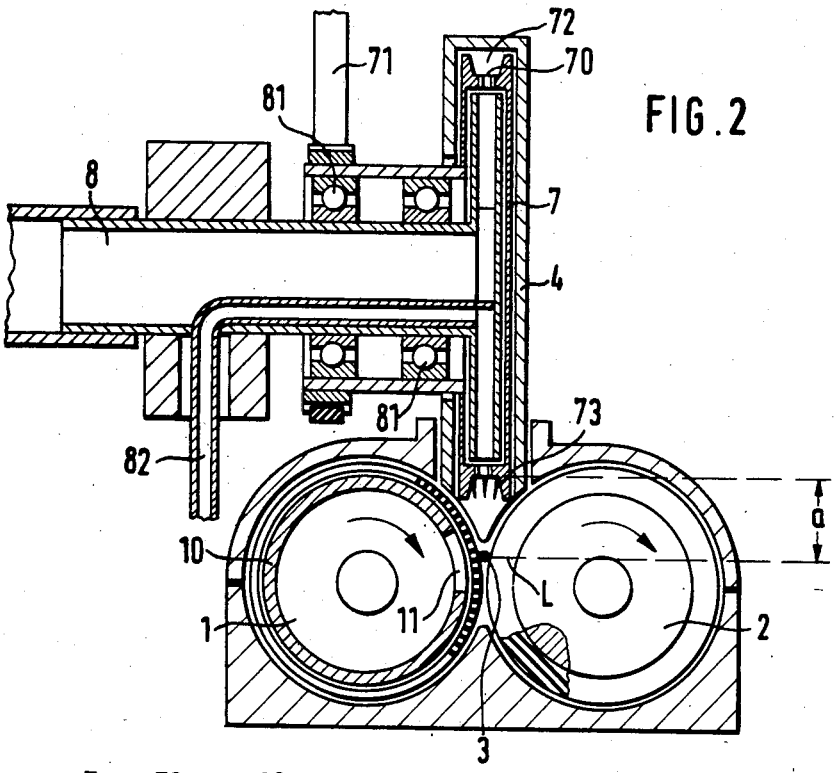
FIG. 2 is a side-view or the cross-section of the invention seen in FIG. 1.
Figure 1:
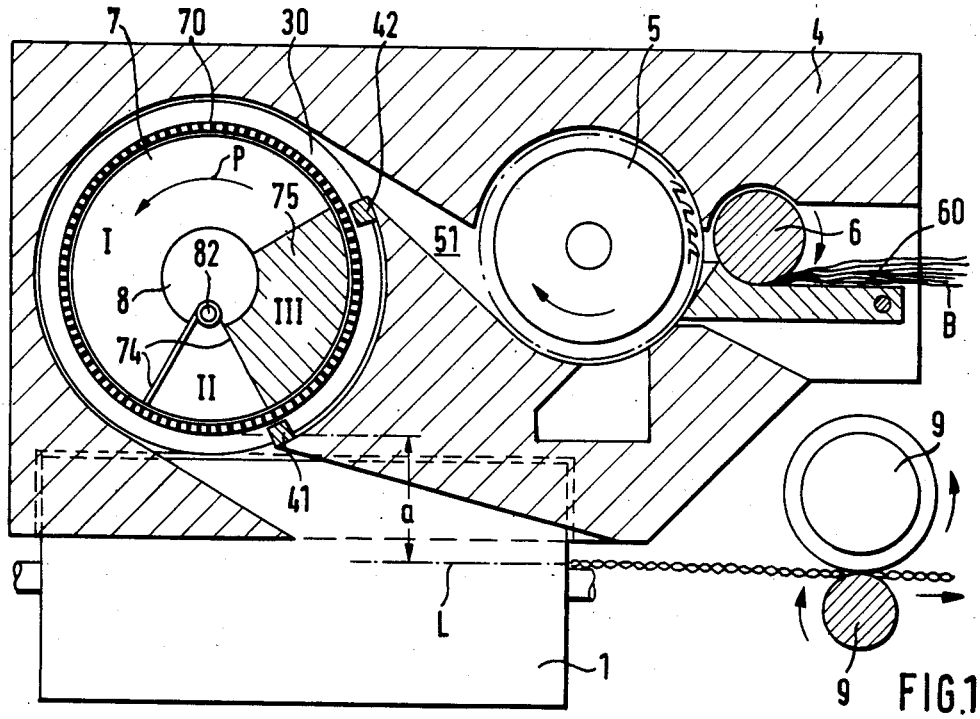
FIG. 1 shows a cross-section of an embodiment of the spinning device according to the invention having a pair of friction rollers which assume the role of twisting device.

FIG. 1 shows one of two friction rollers 1 and 2 which, as can be seen in FIG. 2, are installed parallel and in close proximity to each other. Friction rollers 1 and 2 are driven in the same direction in a manner not shown in further detail, such as for example by means of a tangential belt. The friction roller 2, rotates away from the spinning nip and is not perforated and not subjected to suction. Friction roller 1, rotating towards the spinning nip has a perforated casing surface and is equipped with a suction insert 10 (FIG. 2) connected to a suction device (not shown). Suction insert 10 is provided with a slit 11 extending in the longitudinal direction of spinning nip 3, and the suction air stream is drawn through said slit. The design of the friction rollers has no bearing upon the invention. It would also be possible to subject both friction rollers to suction air.

The separation of the fiber material to be spun into single fibers is effected by means of an opening device installed in a housing 4. Said opening device consists of an opening roller 5 with a garniture, preceded by a feeding device which consists of feeding roller 6, functioning jointly with a feeding trough 60.

Between the opening roller 5 and the friction rollers 1 and 2, a disk-like cylinder 7, enclosed in housing 4 is rotatably supported on bearings. On the periphery of said cylinder is a collecting surface 70. Collecting surface 70 is connected to opening device 5 through a fiber channel 51 which opens nearly tangentially onto collecting surface 70 in the direction of its rotation, the width of said fiber channel being adapted to the width of collecting surface 70.

Cylinder 7 is supported by roller bearings 81 on a hollow shaft 8 mounted in the machine frame and is suitably driven by a tooth belt in the direction of arrow P. Cylinder 7 should reach as far as possible into the nip zone.

The collecting surface 70 is preferably grooved, the bottom of the groove being rounded so that the fiber material required for the formation of the yarn may be accepted completely and may be preformed in width and thickness. As it is conveyed in direction of the spinning nip 3, the fiber material is held fast by a suction air stream on the bottom of groove 72 which forms the collecting surface 70 and is perforated.

For this purpose, the disk-like cylinder 7 is connected to a suction device (not shown) through a hollow shaft 8. The suction air stream however takes effect only in a sector I on the collecting surface, said suction air stream extending in the sense of movement of collecting surface 70 from the point of arrival 30 of the fibers on said collecting surface 70 up to a second sector II. The second sector II is kept free from the suction air stream by means of the separator walls 74. It may, however, be useful to introduce an air stream into sector II, said air stream flowing outwardly through collecting surface 70 in the direction of the spinning nip 3. Since the friction roller 1 is subjected to suction and since housing 4 is sealed and extends beyond the friction rollers 1 and 2, this air flow is created by sucking in air from Sector II. The air required for this is brought in through a pipe 82, inserted in the hollow shaft 8, said pipe 82 connecting Sector II with the atmosphere.

In order to avoid random air currents in the area of fiber feeding to the collecting surface 70 and a in order to expose the fibers conveyed through fiber channel 51 exclusively to an air stream ensuring their oriented depositing on collecting surface 70 in the direction of its movement, a Sector III, following Sector II and reaching up to the outlet of fiber channel 51 is kept free from air streams by means of a fixedly mounted screen 75. In addition to this, seals 41 and 42 are installed on housing 4, at the beginning and at the end of this Sector III. At the same time, seals 41 and 42 also act as stripping devices and exert a cleaning or wiping action upon collecting surface 70.

The opening device consists, as is known to the art, of a rapidly rotating garniture roller fitted with saw tooth wire said roller being tightly enclosed in a housing in the walls of which dirt separator openings are provided.

For the spinning process, the fiber material is brought by wa of a feeding trough 60 in form of fiber sliver B by means of feeding roller 6 to the opening roller 5 which separates the fibers. The negative air pressure in Sector I of cylinder 7 produces a conveying air stream which conveys the separated fibers through fiber channel 51 to collecting surface 70 on which the fibers are deposited.

The individual fibers coming from the opening device 5 join the previously supplied fibers one by one and are incorporated into the thread end. The surface speed of collecting surface 70 is approximately equal to the thread draw-off speed. Thus, an accumulation, and thereby doubling of the fiber mass required for the finished thread takes place on collecting surface 70. Friction rollers 1 and 2 now only serve as a twisting device, so that no overfeeding to the already finished thread takes place.

If the surface speed of the fiber collecting surface 70 is slightly lower than the thread draw-off speed, the doubling process on collecting surface 70 is further increased. At the same time a pull is exerted upon the forming thread on the collecting surface, so that a stretching or drafting effect occurs. The movement of collecting surface 70 in the direction of thread draw-off decreases the requirement of force needed for thread draw-off, so that the thread is not overloaded and so that no unwanted delays occur.

Figure 3:
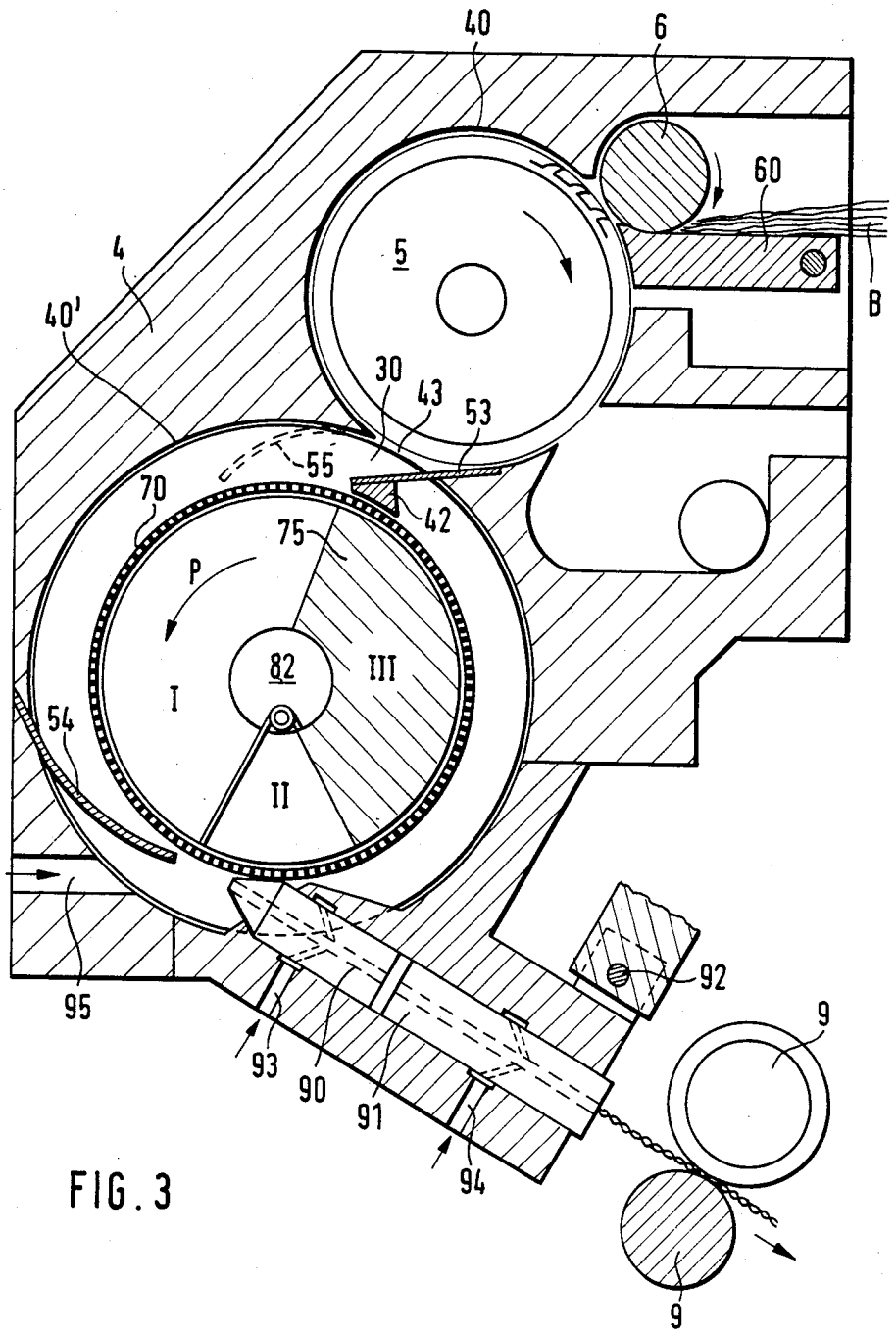
FIG. 3 shows a cross-section of another embodiment of the device according to invention with a pneumatic twisting device.

The embodiment shown in FIG. 3 is different from the device shown in FIGS. 1 and 2 essentially, in that a pneumatic twisting device is used to impart rotation, and in that the housings defined by walls 40 and 40' of the opening roller 5 and of cylinder 7' are installed in immediate proximity of each other so that fiber channel 51 is eliminated. The two housings are connected through a common connection opening 43 through which the fibers are conveyed from the opening roller 5 to the collecting surface 70. Cylinder 7' is adapted here to the width of opening roller 5 and is equipped with guides tapering into a V which lead the fibers together from th width of the opening roller 5 to the width of collecting surface 70. Because of the direct transition of the fibers from opening roller 5 to collecting surface 70, interfering influences throughout a fiber channel are avoided. Also, less conveying air is required because of the shorter conveying distances. Cylinder 7' is subjected to suction air, essentially in order to hold the fibers on collecting surface 70.

The opening roller 5 is equipped with a guiding plate 53 which is attached to housing 4 and which extends from the point on which the fibers detach themselves from the opening roller nearly to the collecting surface 70. Guide plate 53 performs a sealing function at the same time. It ensures the connection with the fixed screen 75 in Sector III and, if need be, also with an additional sealing means 42 attached to guide plate 53 to prevent the fibers from being exposed to an air stream flowing in a direction opposite to the movement of collecting surface 70, so that they may exclusively follow the air stream in the direction of the rotation of collecting surface 70 to be deposited on said collecting surface 70 in an oriented fashion. The seal 41, installed at the beginning of Sector III in the sense of rotation of cylinder 7, is preferably used in this embodiment too, and similarly to the seal 42 attached on guide plate 53 it also serves as a cleaning device. Between connecting opening 43 and Sector II a screen 54 is furthermore installed, said screen extending close to collecting surface 70 (FIG. 3). Screen 54 prevents the fibers from being seized by the suction air flowing towards friction roller 1 before they are deposited on collecting surface 70. Furthermore, the fibers are protected from the air stream coming from friction rollers 1 and 2 under whose influence they could leave the collecting surface 70 too early and out of control. In order to ensure better fiber guidance from the opening device 5 up to collecting surface 70, a fiber guide plate 55 can additionally be provided following the connecting opening 43.

The pneumatic twisting device used to impart rotation contains an injection nozzle 90 and following it a twisting nozzle 91. The twisting device is fixedly installed in a housing part that is pivotable around an axis 92, in the sense of thread draw-off, said housing part being provided with air inlet openings 93 and 94 for the injection nozzle 90 and for the twisting nozzle 91. A bypass 95 in housing 4 is connected to the outlet of the injection nozzle 90 and is located in immediate proximity to the collecting surface 70. As shown for the example of in FIGS. 1 and 2, the twisted thread is drawn off from the collecting surface 70 by means of a pair of draw-off rollers 9. It is, of course, possible to use other pneumatic or mechanical twisting devices to impart rotation. In all other respects the functions of this device are identical to those of the device in FIGS. 1 and 2.

I claim:

1. An open-end spinning process for converting a fiber sliver into yarn, comprising the steps of:

(a) separating said fiber sliver into individual fibers;
(b) aligning said fibers along their longitudinal axes;
(c) conveying said aligned fibers in an air stream to a collection surface;
(d) moving said collection surface in the direction said fibers are conveyed by said air stream;
(e) depositing said fibers onto said collection surface in a continuous bundle of aligned fibers, said fibers being aligned in the direction of said surface is moving;
(f) removing said continuous bundle of fibers from said collection surface in a direction tangent to said collection;
(g) twisting said bundle of fibers into yarn as it is removed from said collection surface; and
(h) winding said yarn onto a package.

2. An open-end spinning process as set forth in claim 1, wherein said fiber bundle contains the fiber mass needed to form the desired yarn.

3. An open-end spinning process as set forth in claim 1, wherein said yarn bundle is twisted after it leaves the collection surface.

4. An open-end spinning process as set forth in claim 3, wherein the fiber bundle formed on the collection surface is deposited in the spinning nip formed by two cylinders in close proximity of each other and driven in the same direction for twisting said bundle of fibers into a yarn.

5. An open-end spinning apparatus for converting a fiber sliver into yarn, comprising:

(a) means for separating fibers from said fiber sliver and for aligning said fibers along their longitudinal axes;
(b) pneumatic means for conveying said aligned fibers in the direction of their longitudinal axes;
(c) collection means for collecting said aligned fibers onto a surface moving in the direction said fibers are conveyed by said pneumatic means in the form of a continuous bundle of fibers;
(d) means for removing said continuous fiber bundle from said moving surface;
(e) means for twisting said bundle of fibers into yarn as it is removed from said moving surface; and
(f) means for winding said yarn onto a package.

6. An open-end spinning apparatus as set forth in claim 6, wherein said collection surface is located on the periphery of a disk-like cylinder.

7. An open-end spinning apparatus as set forth in claim 5, wherein the surface speed of the collection surface is approximately equal to the speed of yarn draw-off.

8. An open-end spinning apparatus as set forth in claim 5, wherein the surface speed of the collection surface is less than the speed of yarn draw-off.

9. An open-end spinning apparatus as set forth in claim 5, wherein the collection surface has a groove formed therein.

10. An open-end spinning apparatus as set forth in claim 9, wherein the width of said groove corresponds approximately to the thckness of the fiber bundle.

11. An open-end spinning apparatus as set forth in claim 9, wherein the cross-sectional shape of said groove is V-shaped.

12. An open-end spinning apparatus as set forth in claim 9, wherein the bottom of said groove is rounded.

13. An open-end spinning apparatus as set forth in claim 5, wherein said collection surface is perforated and air is drawn through said perforations.

14. An open-end spinning apparatus as set forth in claim 13, wherein said collection surface has a first sector with an inwardly directed air stream passing inwardly through said collection surface and said fibers to hold said fibers onto said surface for a predetermined arcuate sector of said collection surface.

15. An open-end spinning apparatus as set forth in claim 14, wherein an outwardly directed air stream flows through said collection surface in the area of a second sector for removing said fiber bundle from said surface.

16. An open-end spinning apparatus as set forth in claim 15, wherein said second sector of the collection surface is connected to the atmosphere.

17. An open-end spinning apparatus as set forth in claim 15, wherein said collection surface is enclosed in a housing.

18. An open-end spinning apparatus as set forth in claim 17, wherein the collection surface is preceded by said means for separating said fibers within said housing.

19. An open-end spinning apparatus as set forth in claim 18, wherein said means for separating fibers from said fiber sliver is connected to said collection surface by a connecting channel extending tangentially from said separating means to said collection surface, whereby the outlet for said connecting channel is adapted to the width of said collection surface.

20. An open-end spinning apparatus as set forth in claim 18, wherein the housing for the fiber separating means and the housing for said collection means are located in the immediate proximity to each other and are connected to each other through a connecting opening.

21. An open-end spinning apparatus as set forth in claim 20, wherein fiber guiding elements are disposed in the area of said connecting opening.

22. An open-end spinning apparatus as set forth in claim 21, wherein a screen is disposed adjacent to said collection surface at the end of said first sector.

23. An open-end spinning apparatus as set forth in claim 5, wherein means are provided for removing residual fibers from said collection surface after said yarn bundle is withdrawn therefrom.

24. An open-end spinning apparatus as set forth in claim 5, wherein said twisting means comprises a pair of friction rollers driven in the same direction and forming a spinning nip, whereby the axes of movement of said collection surface lies in a plane perpendicular to said spinning nip.

25. An open-end spinning apparatus as set forth in claim 5, wherein said twisting means comprises a pneumatic twisting element.

* * * * *